United States Patent [19]

Carlson

[11] Patent Number: 4,956,868

[45] Date of Patent: Sep. 11, 1990

[54] MAGNETICALLY SHIELDED ELECTROMAGNETIC ACOUSTIC TRANSDUCER

[75] Inventor: Elmer V. Carlson, Prospect Heights, Ill.

[73] Assignee: Industrial Research Products, Inc., Elk Grove Village, Ill.

[21] Appl. No.: 426,999

[22] Filed: Oct. 26, 1989

[51] Int. Cl.[5] ..... H04R 1/02

[52] U.S. Cl. ..... 381/189; 381/199

[58] Field of Search ..... 381/189, 194, 199, 200, 381/201, 195, 196, 197, 198; 307/91

[56] References Cited

U.S. PATENT DOCUMENTS 3,111,563 11/1963 Carlson .
3,177,412 4/1965 Carlson .
3,347,992 10/1967 Carlson .
3,515,818 6/1970 Tibbetts .
3,560,667 2/1972 Carlson .
3,588,383 6/1971 Carlson .
3,671,684 6/1972 Tibbetts et al. .
3,935,398 1/1976 Carlson et al. .
4,272,654 6/1981 Carlson .
4,430,520 2/1984 Tibbetts et al. .

*Primary Examiner*—Jin F. Ng
*Assistant Examiner*—M. Nelson Geary, III
*Attorney, Agent, or Firm*—Kinzer, Plyer, Dorn, McEachran & Jambor

[57] ABSTRACT

An electromagnetic transducer including a diaphragm mechanically connected to an armature, a coil wound tranversely around the armature, a permanent magnet adjacent the armature, and one or more additional magnetic members completing a magnetic circuit having a plane of symmetry longitudinally bisecting the armature, has a magnetic shield formed by two high-permeability casing halves joined together along a joint plane substantially concident with the plane of symmetry.

5 Claims, 1 Drawing Sheet

Fig. 1.
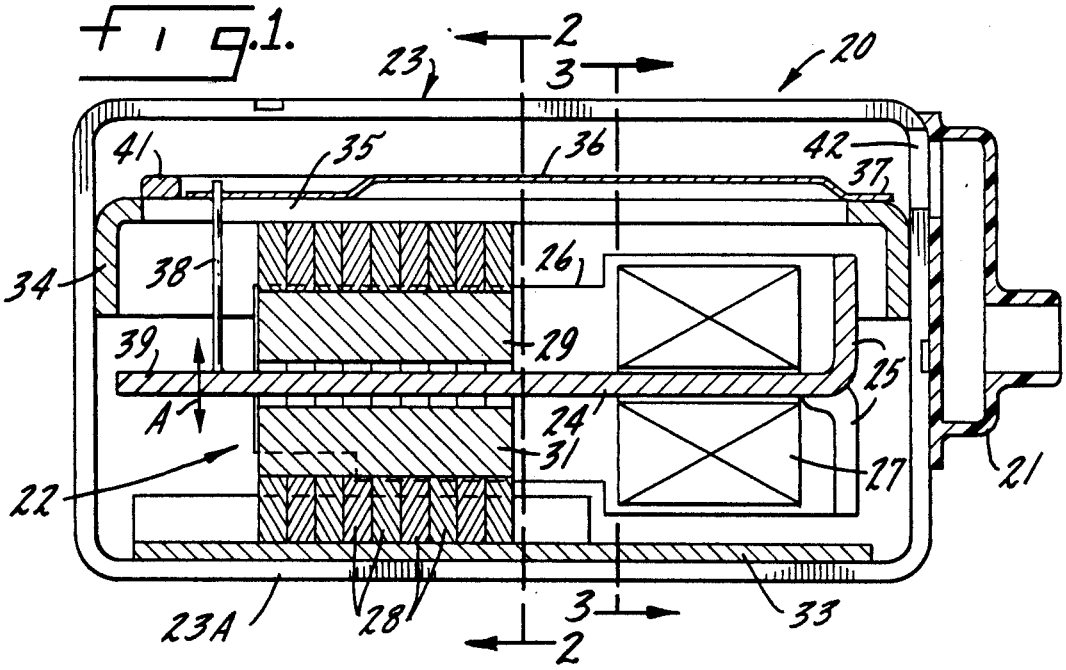
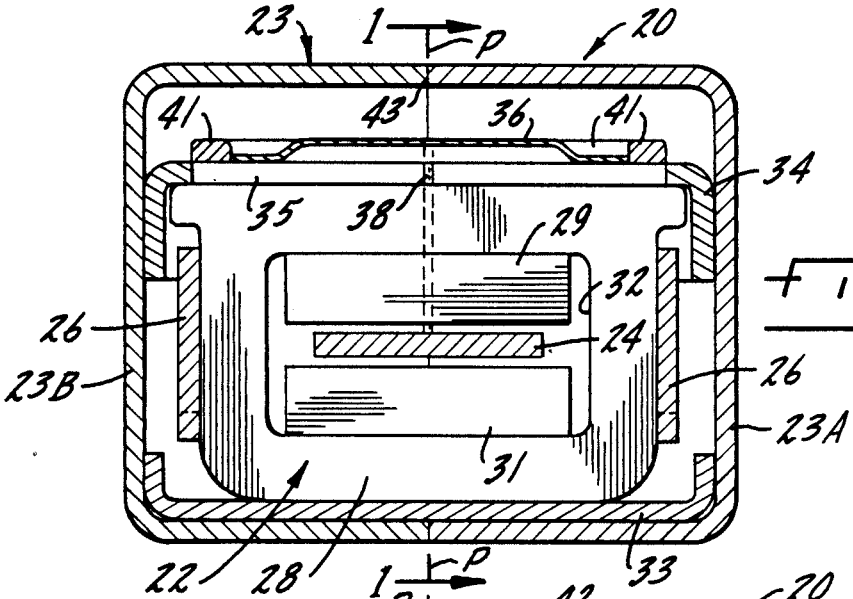
Fig. 2.
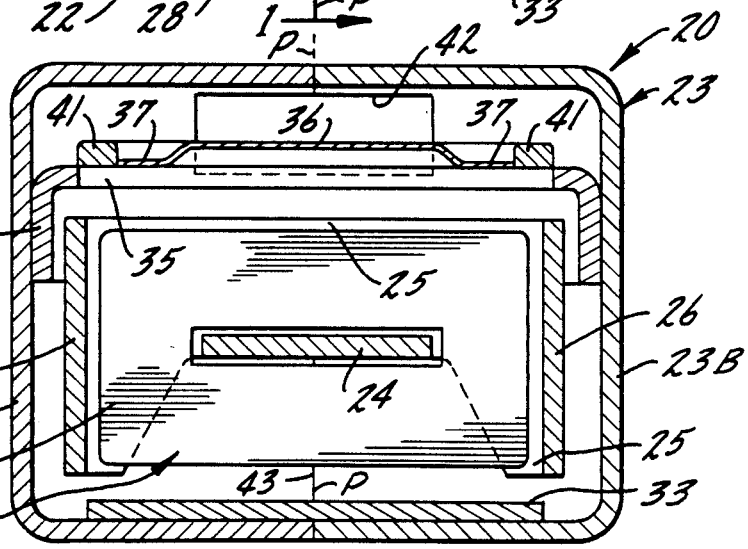
Fig. 3.

MAGNETICALLY SHIELDED ELECTROMAGNETIC ACOUSTIC TRANSDUCER

BACKGROUND OF THE INVENTION

An electromagnetic hearing aid receiver or other comparable electromagnetic acoustic transducer inherently generates a magnetic field; without shielding, a substantial portion of that field is radiated externally of the transducer. This external magnetic field will induce spurious signals in any other electromagnetic device in the immediate vicinity. The external magnetic field around an electromagnetic hearing aid transducer frequently creates spurious feedback signals in a pickup coil employed for coupling the hearing aid to a telephone receiver.

A substantial improvement in containment of the external field of an electromagnetic hearing aid receiver is provided in the transducer construction having a magnetic shield that is described and claimed in Carlson U.S. Pat. No. 3,111,563. Although the self-shielding receiver construction covered by that patent affords appreciable improvement in minimizing the effect of the external field of an electromagnetic hearing aid receiver or like device, it does not solve the problem completely. Thus, most hearing aid receivers and other electromagnetic transducers, particularly miniature devices, continue to present appreciable problems when brought into close proximity with other electromagnetic transducers or couplers, whether microphones or receivers or coupling coils. The present invention is intended to remedy this situation and to provide much better and more effective shielding than has previously been afforded.

SUMMARY OF THE INVENTION

The principal object of the present invention, therefore, is to provide a new and improved construction for a magnetically shielded electromagnetic acoustic transducer, particularly one suitable for use as a hearing aid receiver, that is simple and inexpensive but affords better suppression of external electromagnetic fields than achieved in previously known transducers of this general kind.

Accordingly, the invention relates to a magnetically shielded electromagnetic acoustic transducer comprising an acoustic diaphragm, a magnetic armature, mechanical drive connection means interconnecting the armature and the diaphragm, an electromagnetic coil disposed in encompassing relation to a portion of the armature, and magnetic connection means linking the electromagnet coil and the armature in a complete magnetic circuit having a plane of symmetry across which no appreciable magnetic flux flows. A magnetic shield encompasses the diaphragm, the armature, the coil and both connection means, the shield comprising two generally cup-shaped casing halves of high magnetic permeability joined together along a joint plane closely adjacent to and parallel to the plane of symmetry of the magnetic circuit.

BRIEF DESCRIPTION OF THE DRAWINGS

FIG. 1 is a longitudinal sectional view, on a greatly enlarged scale, of a miniature electromagnetic acoustic transducer utilized as a hearing aid receiver that is magnetically shielded in accordance with the present invention;

FIG. 2 is a sectional view taken approximately along line 2—2 in FIG. 1; and

FIG. 3 is a sectional view taken approximately along line 3—3 in FIG. 1.

DESCRIPTION OF THE PREFERRED EMBODIMENT

Virtually any electromagnetic motor suitable for use in a hearing aid receiver, a miniature microphone, or any other small electromagnetic acoustic transducer has at least one plane of symmetry as regards the magnetic circuit of the device; most such devices have only one plane of symmetry. All practical receiver constructions have the electromagnetic motor located eccentrically within the casing of the device for reasons of space conservation. In modern devices of this kind, the casing is an electromagnetic shield, formed of high permeability magnetic material, functioning in the manner disclosed in the aforementioned Carlson U.S. Pat. No. 3,111,563. The end result is reduced magnetic leakage from the receiver, microphone, or other acoustic transducer; nevertheless, there is still appreciable unbalanced magnetic leakage, at signal frequencies, from these devices.

The usual magnetic shield casing construction employs at least two component members. These shields, formed of magnetic material of high permeability, usually include two cup-shaped members and are joined to each other along a tight-fitting seam that presents a minimal air gap. In conventional constructions, a portion of the leakage flux from the electromagnetic motor that drives the device, whether it is a receiver or a microphone, must cross this seam. The small air gap afforded by the seam emphasizes the weak magnetic poles created at the exterior of the receiver or microphone housing due to the magnetic flux leakage and, in effect, increases the signal frequency magnetic field in the region surrounding the device. In other words, the seam in the magnetic shield housing for the receiver or other transducer exacerbates the radiation and feedback problems noted above.

In the acoustic transducers of the present invention, the magnetic shield casing is modified so that there are just two shield casing halves, and those two halves are joined along a seam that is aligned with a reliable plane of symmetry for the motor of the receiver, microphone, or other transducer. That is, in the transducers of the present invention the shield seam is located where there is no imbalance in the flux escaping from the motor so that no appreciable magnetic flux crosses the joint between the halves of the casing that forms the magnetic shield for the device.

FIGS. 1-3 illustrate a magnetically shielded electromagnetic acoustic transducer 20 constructed in accordance with a preferred embodiment of the present invention. Transducer 20 is a hearing aid receiver, small enough to fit into the ear of a user. A small end portion 21 of the housing of device 20 (FIG. 1) has a configuration to fit a short, small tube which conducts the sound into the outer portion of the ear canal of the user. Transducer 20 comprises a motor 22 mounted in an external shield casing 23 formed in two halves 23A and 23B.

Motor 22 of transducer 20 includes a relatively flexible elongated lever-like armature member 24 that extends almost the full length of the interior of casing 23. One end of armature 24 is joined to two vertically extending end walls 25; this is the anchor end for armature 24. The overall armature structure also includes a pair of side walls 26 that extend along most of the armature length but are spaced from the main armature member 24.

An electromagnetic coil 27 is mounted in encompassing relation to armature member 24 adjacent its anchor end, by walls 25. Further along, a portion of armature member 24 is encompassed by a stack of magnetic laminations 28. Two permanent magnets 29 and 31 are mounted within the central opening 32 in laminations 28, the two permanent magnets being disposed on opposite sides of armature 24. That is, magnetic laminations 28, which are transverse to armature 24, enclose the two permanent magnets 29 and 31 as well as a portion of armature member 24. Motor 22 further comprises a base 33 on which the stack of laminations 28 are mounted and a generally cup-shaped support plate 34 that fits over and is affixed to the top of the stack of laminations 28. Support plate 34, as best shown in FIG. 1, extends for the full length of transducer 20. There is a large central aperture 35 in the support plate.

The receiver or other electromagnetic transducer 20, FIGS. 1-3, further comprises a diaphragm 36 having a rim 37 affixed at one end to support plate 34 (FIG. 1). The other end of diaphragm 36 is connected to a drive pin 38. Drive pin 38 is also connected to the free end 39 of armature 24. Diaphragm 36 covers the large opening 35 in support plate 34. The edges of the diaphragm may be encompassed by a generally U-shaped welt 41.

With the exception of the construction employed for casing 23, discussed in greater detail hereinafter, transducer 20 is generally conventional in construction, so that only a brief description of its operation is necessary. Assuming that transducer 20 is utilized as a receiver, it is seen that it has a constant magnetic flux, provided by permanent magnets 29 and 31, in a closed magnetic circuit that includes armature 24, both permanent magnets, laminations 28, and the armature side members 26. This constant flux from the permanent magnets does not vibrate diaphragm 36 and does not provide an output signal to the user. To generate an output from device 20, when utilized as a receiver, an electrical signal is supplied to coil 27. This generates a variable magnetic flux in the same circuit as described for the permanent magnet flux. The variable magnetic flux causes the free end 39 of armature 24 to vibrate as indicated by arrows A. This vibrational movement of armature 24 is transmitted to diaphragm 36 by drive pin 38. The resulting movement of diaphragm 36 produces an acoustic output through housing opening 42 and output housing 21 (FIG. 1) to the user of the receiver.

When a signal current is applied to coil 27, the various portions of armature 24, armature end walls 25, armature side walls 26, laminations 28 and magnets 29 and 31 assume differing magnetic potentials in response to that signal current. It is these magnetic potential differences that produce an extraneous magnetic field around the motor, and it is this extraneous field that housing 23 is to shield or contain. This extraneous field, due to the symmetry of the motor, also has a symmetry of its own.

Device 20 can also function as a microphone. When used for this purpose, sound waves impinging upon diaphragm 36 cause it to vibrate. The diaphragm movement drives the free end 34 of armature member 24 (arrows A) and produces variations in the flux in the magnetic circuit decribed above. These flux variations induce corresponding currents in coil 27, which serves as the microphone output coil; the extraneous field difficulties are essentially like those produced by receiver operation.

Like virtually any conventional electromagnetic transducer, whether used as a receiver or as a microphone, device 20 exhibits a plane of magnetic symmetry P across which no appreciable magnetic flux flows. This plane is identified in both FIGS. 2 and 3; it runs longitudinally of armature 24 down the center of the armature. The external shield 23 of device 20 has its two cup-shaped casing halves 23A and 23B joined together in a seam coincident with plane P. However, the joint or seam 43 between casing halves 23A and 23B need not coincide precisely with plane P; there is little or no magnetic flux laterally the central part of armature member 24 or in a direction transverse to the armature through any of the encompassing magnetic circuit elements such as magnets 29 and 31 or laminations 28. The plane of joint 43 can be displaced a short distance to the right or the left of the plane of magnetic symmetry P, as seen in FIGS. 2 and 3, as long as the displacement is not unduly large. That is, it is sufficient that the plane of shield joint 43 be parallel to and in close proximity to the plane of magnetic symmetry P.

With the construction shown in FIGS. 1-3, in which the joint or seam 43 between the high permeability shield halves 23A and 23B is generally coincident with the plane of magnetic symmetry P, the seam does not interrupt the flux path through the magnetic circuit of the transducer motor 22. Consequently, the shielding effect is determined solely by the magnetic properties of casing 23 itself. This is not a perfect solution to the difficulties of magnetic field radiation from transducer 20; there may still be some limited leakage flux at signal frequencies. However, the illustrated construction, with seam 43 parallel to and closely adjacent to plane P, affords a noticeable improvement over magnetic shield casings of the kind previously known in the art.

I claim:

1. A magnetically shielded electromagnetic acoustic transducer comprising:
   - an acoustic diaphragm;
   - a magnetic armature;
   - mechanical drive connection means interconnecting the armature and the diaphragm;
   - an electromagnetic coil disposed in encompassing relation to a portion of the armature;
   - magnetic connection means linking the electromagnet coil and the armature in a complete magnetic circit having a plane of symmetry across which no appreciable magnetic flux flows;
   - and a magnetic shield encompassing the diaphragm, the armature, the coil, and both connection means,
   - the magnetic shield comprising two generally cup-shaped casing halves of high magnetic permeability joined together along a joint plane closely adjacent to and parallel to said plane of symmetry.

2. A magnetically shielded electromagnetic acoustic transducer according to claim 1 in which the armature is an elongated, relatively flexible magnetic lever anchored at one end, the mechanical drive conection means is affixed to the other end of the armature, and the coil encompasses a medial portion of the armature.

3. A magnetically shielded electromagnetic acoustic transducer according to claim 1 and further comprising permanent magnet means, adjacent the armature, for inducing a constant magnetic flux in the armature, the permanent magnet means being included in said magnetic circuit.

4. A magnetically shielded electromagnetic acoustic transducer according to claim 3 in which the armature is an elongated, relatively flexible magnetic lever anchored at one end, the mechanical drive connection means is affixed to the other end of the armature, and the coil and the permanent magnet means each encompass a medial portion of the armature.

5. A magnetically shielded electromagnetic transducer according to claim 3 in which the magnetic connection means includes a plurality of magnetic laminations, transverse to the armature, encompassing the permanent magnet means and the armature.

* * * * *